US006966447B2

(12) United States Patent
Hiltke et al.

(10) Patent No.: US 6,966,447 B2
(45) Date of Patent: Nov. 22, 2005

(54) CORRUGATED DISPLAY BASE

(75) Inventors: Eric Hiltke, Wyckoff, NJ (US); Wayne Schultz, Doylestown, PA (US)

(73) Assignee: Smurfit-Stone Container Corporation, St. Louis, MO (US)

( * ) Notice: Subject to any disclaimer, the term of this patent is extended or adjusted under 35 U.S.C. 154(b) by 27 days.

(21) Appl. No.: 10/197,045

(22) Filed: Jul. 17, 2002

(65) Prior Publication Data

US 2002/0175133 A1 Nov. 28, 2002

Related U.S. Application Data

(63) Continuation of application No. 09/489,900, filed on Jan. 24, 2000, now abandoned.

(51) Int. Cl.[7] ..... A45D 19/04

(52) U.S. Cl. ..... 211/132.1; 211/72; 211/149; 248/174

(58) Field of Search ..... 211/132.1, 72, 211/149; 248/174

(56) References Cited

U.S. PATENT DOCUMENTS

| | | | | |
|---|---|---|---|---|
| 1,342,313 | A | 6/1920 | Stranders | |
| 1,684,753 | A | 9/1928 | Zareko | |
| 1,892,194 | A | 12/1932 | Taylor | |
| 1,983,374 | A | 12/1934 | Intemann | |
| 2,107,991 | A | 2/1938 | Thomas | |
| 2,114,528 | A | 4/1938 | Ghiselin | |
| 2,688,408 | A | 9/1954 | Binggely | |
| 2,881,662 | A | 4/1959 | Harris | |
| 2,940,710 | A | 6/1960 | Adams | |
| 3,357,671 | A | 12/1967 | Ketterer | |
| 3,987,737 | A | * 10/1976 | Smith | 108/179 |
| 3,987,898 | A | * 10/1976 | Crane | 206/300 |
| 4,001,958 | A | 1/1977 | Fecko | |
| 4,384,651 | A | 5/1983 | Smith | |
| 4,570,805 | A | 2/1986 | Smith | |
| 4,591,047 | A | 5/1986 | March | |
| RE32,668 | E | * 5/1988 | Smith | 211/149 |
| 4,813,536 | A | * 3/1989 | Willis | 206/765 |
| 4,991,804 | A | * 2/1991 | Iannucci | 248/174 |
| 5,014,455 | A | 5/1991 | Desaderata | |
| 5,060,790 | A | * 10/1991 | Kindelberger et al. | 211/132.1 |
| 5,135,157 | A | 8/1992 | Cruz | |
| 5,145,062 | A | * 9/1992 | Crispi | 206/233 |
| 5,161,699 | A | 11/1992 | Hanna et al. | |
| 5,186,319 | A | * 2/1993 | Ting | 206/763 |
| 5,230,423 | A | * 7/1993 | Gellatly | 206/764 |
| 5,253,769 | A | * 10/1993 | Vlastakis | 211/126.16 |
| 5,513,745 | A | 5/1996 | Zoltan et al. | |
| 5,630,518 | A | 5/1997 | Collins | |
| 5,826,732 | A | 10/1998 | Ragsdale | |
| 5,868,371 | A | * 2/1999 | Nuzzo | 248/346.01 |
| 6,098,820 | A | * 8/2000 | Smith | 211/132.1 |
| 6,168,033 | B1 | * 1/2001 | Wilkins | 211/132.1 |
| 6,488,245 | B1 | * 12/2002 | Maglione | 248/174 |
| 6,581,895 | B1 | * 6/2003 | Pleasant | 248/459 |
| 2003/0160015 | A1 | * 8/2003 | Broerman | 211/149 |

FOREIGN PATENT DOCUMENTS

| | | | | |
|---|---|---|---|---|
| GB | 2213101 | * 8/1989 | | 211/132.1 X |

* cited by examiner

*Primary Examiner*—Bruce A. Lev
(74) *Attorney, Agent, or Firm*—Paul M. Derik

(57) ABSTRACT

An upright display stand for mounting a hanging display tray erected from a corrugated paperboard blank. The display stand includes rectangular front panel having a locking slot for engagement of a transverse brace with the upper edge of the front panel including spaced apart notches for the engagement of hooks on the back of the hanging display tray. The display stand also includes a first integral side panel and a second integral side panel of generally triangular configuration and a rear panel. The upper end of the rear panel includes an integral brace section which folds downwardly and inwardly to engage the locking slot formed in the front panel to create the transverse brace. The display stand, when fully assembled, is generally rigid and stable and well suited to support a hanging display tray.

7 Claims, 3 Drawing Sheets

CORRUGATED DISPLAY BASE

CROSS REFERENCE TO RELATED APPLICATIONS

This application is a continuation of U.S. patent application Ser. No. 09/489,900, and was filed on Jan. 24, 2000 now abandoned.

BACKGROUND OF THE INVENTION

This invention relates generally to paperboard display apparatus and, more specifically, to a paperboard display having an upright base to support a paperboard tray, particularly a hanging display tray.

Generally speaking, paperboard display trays are known to the art. They can be used to display for viewing and/or sale a multitude of items or products from good stuffs to eyeglasses to toys or apparel. Hanging display trays have been employed which include a corrugated paperboard tray having plastic or metal hooks on the back. The hooks are used to hang the tray in a metal store fixture. Hence, the use of such hanging trays are limited to stores, for example, which have appropriate metal fixtures. These metal fixtures can be expensive and lack diversity.

In the past, attempts have been made to provide corrugated paperboard display bases to support the trays, thus eliminating the need for the metal fixtures. These prior paperboard bases generally are limited to the conventional A-frame design with a tuck top. However, this conventional design has several drawbacks. For example, such designs do not provide sufficient rigidity. Furthermore, they can be difficult and time consuming to fold into shape and set up.

Therefore, it would be advantageous to have a corrugated paperboard stand to support a display tray, the stand having improved rigidity while still being easy to erect.

SUMMARY OF THE INVENTION

It is, therefore, among the principal objects of the present invention to provide an upright display stand to hold a hanging display tray.

It is another object of the present invention to provide such an upright display stand that has substantial rigidity. Another object of the present invention is to provide such an upright display stand that is constructed from corrugated paperboard.

Another object of the present invention is to provide such an upright display stand that is economical to manufacture, easy and quick to erect and well suited for its intended purposes.

In accordance with the invention, generally stated, an upright display stand for mounting a hanging display tray is provided formed from a corrugated paperboard blank including a generally rectangular front panel, the upper edge of the front panel having spaced apart notches for the engagement of hooks on the hanging display. The front panel also has a locking slot for engagement of a transverse brace. The display stand includes a first integral side panel and a second integral side panel of generally triangular configuration. One of the side panels includes an integral substantially rectangular panel which folds inwardly to form a rear panel. The upper end of the rear panel includes an integral brace section which folds downwardly and inwardly to engage the locking slot formed in the front panel to create the transverse brace. The display stand, when fully assembled, is generally rigid and stable and well suited to support a hanging tray.

DETAILED DESCRIPTION OF THE INVENTION

Figure 6:
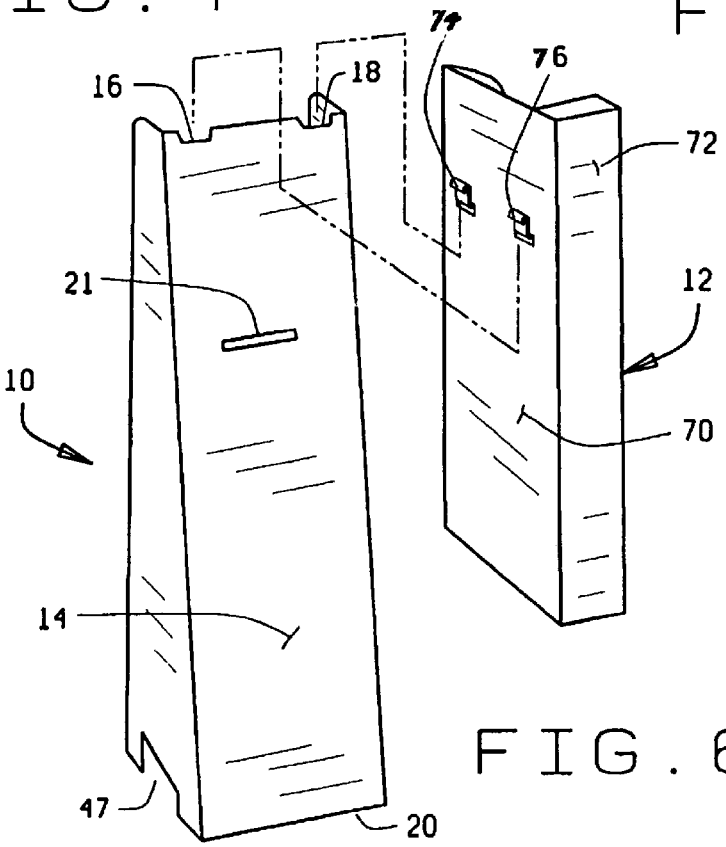
FIG. 6 is an exploded front isometric view of the display stand of the present invention and a hanging tray.
Figure 7:
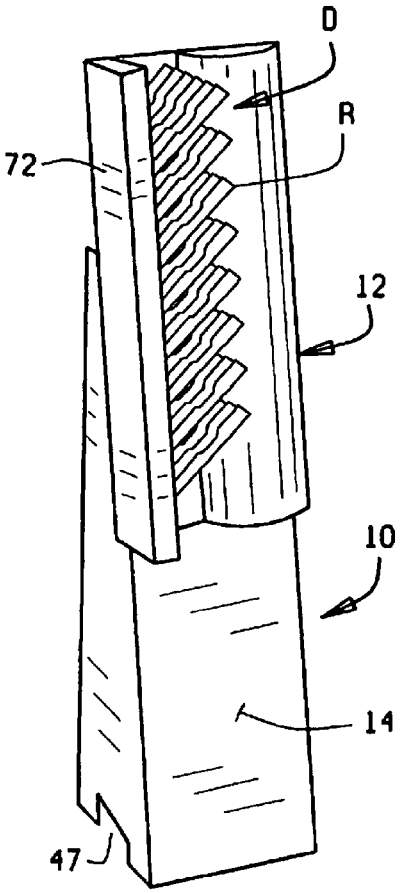
FIG. 7 is a front isometric view of the display stand of the present invention with a hanging tray in place.
Figure 8:
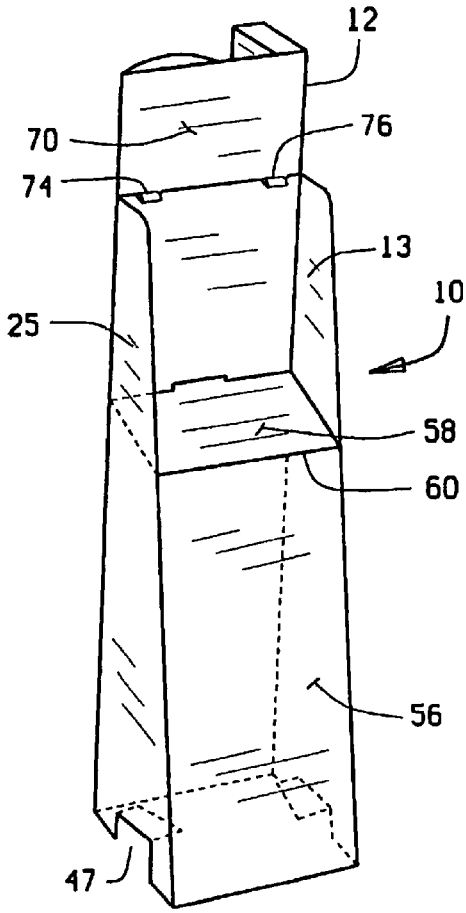
FIG. 8 is a rear isometric view of the display stand of the present invention with a hanging tray in place. Corresponding reference numerals indicate corresponding elements throughout the various drawings.

The display stand for hanging trays of the present invention is indicated generally by reference numeral 10 in the drawings. The display stand 10 is designed to accommodate 'a hanging tray 12 as shown in FIGS. 6–8, as will be explained in greater detail below.

Figure 2:
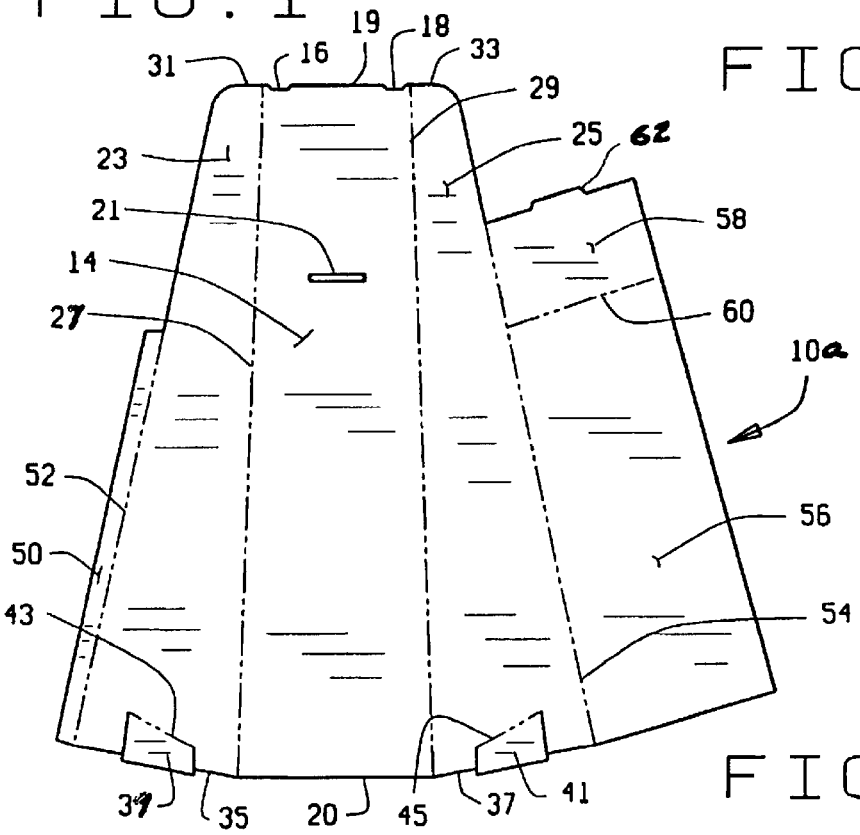
FIG. 2 is a front plan view of the paperboard blank cut to define to the elements of the display stand of the present invention shown prior to folding into its useful configuration.
Figure 4:
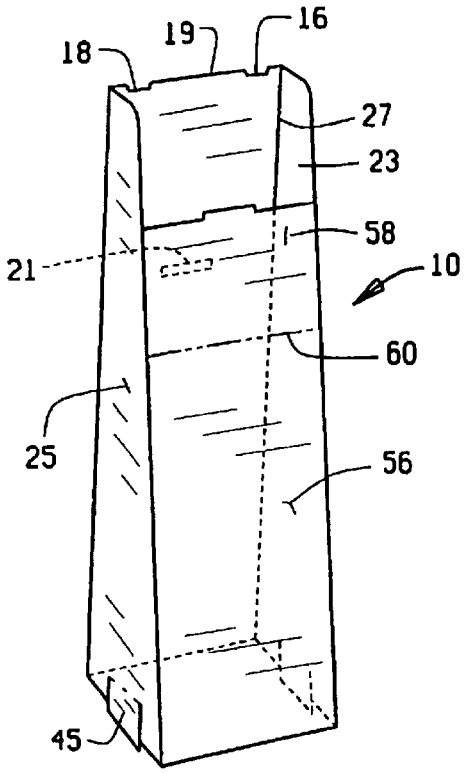
FIG. 4 is a rear isometric view of the display stand of the present invention, the brace section not folded into its useful configuration.

Display stand 10 is erected from a precut blank 10A, as best seen in FIG. 2. The blank 10A can be stamped or cut from sheets or stock of corrugated paperboard, or the like, using an appropriate die. The blank 10A then is folded along predetermined foldlines, which will be described, and erected into display stand 10. Display stand 10 includes a central or front panel 14. Front panel 14 is substantially rectangular in configuration, having a vertical height greater than its width. There is a pair of spaced apart notches 16 and 18 formed in the top edge 19 of front panel 14. Front panel 14 also includes a bottom edge 20. There is a locking slot 21 formed in the front panel 14 approximately one third of the way down the panel from top edge 19.

Figure 1:
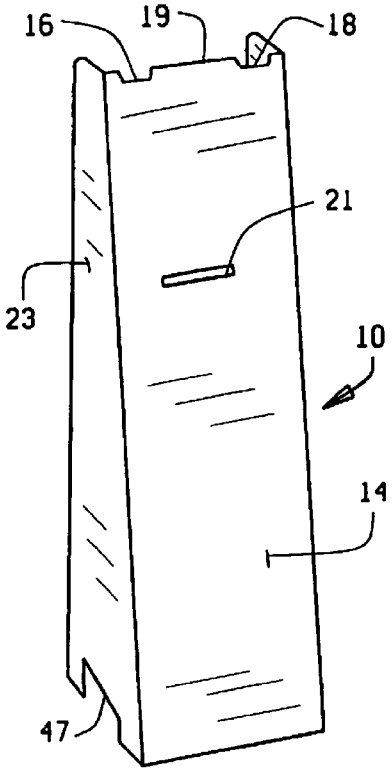
FIG. 1 is a front isometric view of the display stand of the present invention.
Figure 3:
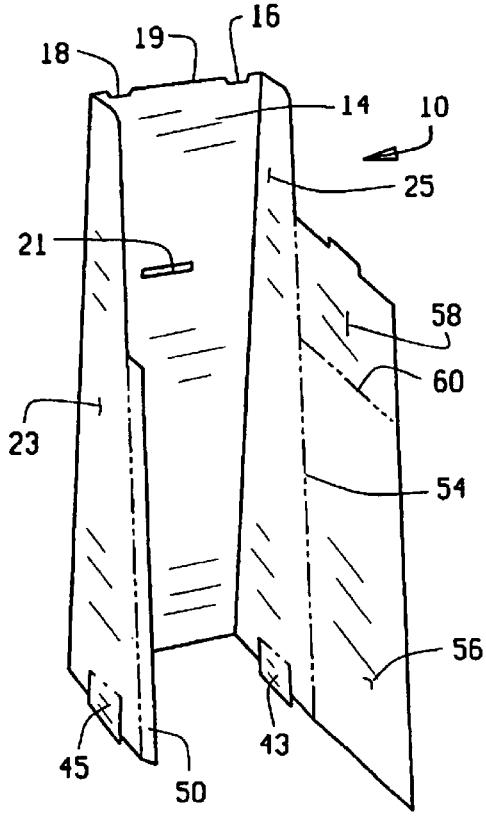
FIG. 3 is a rear isometric view of the display stand of the present invention, the rear panel not folded into its useful configuration.

Display stand 10 also includes a first side panel 23 and a second side panel 25 joined to front panel 14 by fold lines 27 and 29 respectively. Side panels 23 and 25 have top edges 31 and 33, respectively. The width of the side panels 23 and 25 increase down the length of the panels so that respective bottom edges 35 and 37 are substantially longer than the respective top edges 31 and 33, giving the side panels 23 and 25 and overall triangular configuration. As seen in FIG. 2, the bottom edges 35 and 37 of the side panels are angled upwardly from bottom edge 20 of front panel 14. This configuration allows the side panels to rest flush on a support surface, such as the floor, when the display stand 10 is fully erected, as shown in FIG. 1. Bottom edges 35 and 37 also have tabs 38 and 41 formed therein and attached to the side panels by fold lines 43 and 45, respectively. The tabs 38 and 41 can be folded in and up, creating an opening, as at 47 in the bottom edge of each side panel, thereby giving the aesthetically pleasing appearance of legs on the side panels. Side panel 23 has a narrow, integral tuck flap 50 joined along fold line 52. Tuck flap 50 is designed to be folded inwardly and tucked between the rear wall and side panel 23 when the display stand is erected. Attached to side panel 25 at fold line 54 is rear panel 56. Rear panel 56 is substantially rectangular in shape and is somewhat shorter than the front panel 14. Rear panel 56 includes a brace panel 58 connected at fold line 60.

Figure 5:
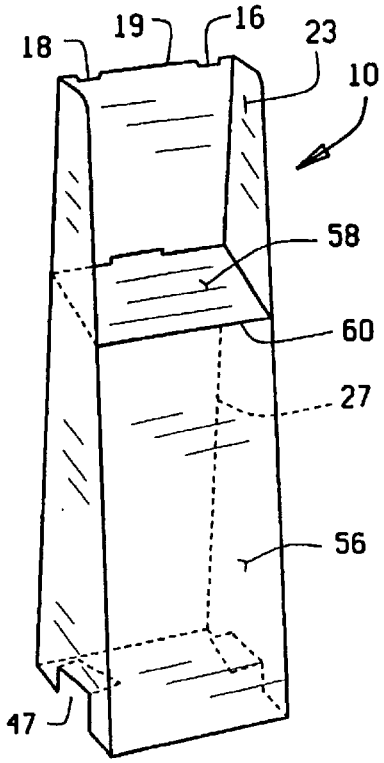
FIG. 5 is a rear isometric view of the display stand of the present invention.

Brace panel 58 has a locking tab 62 on its upper edge. Brace panel 58 folds downwardly and inwardly when the display stand is erected (FIG. 5). Locking tab 62 is designed to engage locking slot 21 in the front panel 14 and secure the brace panel 58 in place, thus providing substantial rigidity to the display stand.

One embodiment of a hanging tray 12 will now be described. The hanging tray 12, as illustrated, is referred to as a winged tray. The hanging tray 12 includes a rear or main panel 70, a side panel 72 and a display area D replete with individual racks R. The racks are designed to hold and display merchandise or the like. The exterior surface of the main panel 70 includes a first and second hook, 74 and 76, respectively which are designed to engage notches 16 and 18 in the front wall 12 of the display stand. The tray 12 thus can be hung and displayed on the display stand 10. It will be appreciated that any configuration and design of hanging tray may be employed as long as it includes hanging elements, such as hooks or the like, to engage the display stand.

It will be appreciated that various changes and modifications may be made in the display stand and hanging tray of the present invention without departing from the scope of the appended claims. Therefore, the foregoing description and accompanying drawings should be construed as illustrative only and should not be understood in a limiting sense.

What is claimed is:

1. A display stand for attachment of a hanging tray comprising:

a substantially planar front panel;

a first side panel;

a second side panel;

a rear panel, said rear panel being slightly shorter than said front panel but no more than half and foldably connected to said second side panel, said rear panel being securable to the first side panel to form the erected display stand;

said rear panel including an integral brace section which is folded angularly downwardly and inwardly from a top of said rear panel to engage said front panel and secure the display stand in a substantially rigid configuration;

said first side panel and said second side panel having a generally triangular configuration, said front panel having a locking slot formed in the upper half of said front panel therein, said integral brace having a locking tab provided thereon to engage with said locking slot of said front panel, said brace being generally incontiguous with said front panel with only its locking tab extending through the locking slot of said front panel.

2. The display stand of claim 1 wherein said front panel includes at least one notch.

3. The display stand of claim 2 further comprising: a hanging tray having at least one attachment element for engaging said at least one notch on said front panel.

4. A display stand comprising;

a front panel having a locking slot formed therein;

a first side panel, connected with said front panel;

a second side panel, connected with said front panel;

a rear panel pivotally connecting to one of said side panels, said rear panel being slightly shorter than said front panel but no more than half and having an integral brace section at its upper end thereof, said brace section extending angularly downwardly and inwardly from the top of said rear panel to engage said front panel, said brace section having a locking tab and said front panel having a locking slot formed in the upper half of said front panel, said locking tab of the rear panel being sized such that said brace section engages said locking slot in said front panel when said display assembly is erected, said brace section being generally incontiguous with said front panel with only its locking tab extending through said locking slot in said front panel; and said brace section capable of folding over and extending between the side panels, and the first side panel having an integral and pivotal tuck flap, said tuck flap capable of securing with the rear panel when the display stand is erected.

5. The display stand of claim 4 further comprising a hanging tray on said front panel.

6. A display assembly comprising;

a front panel having at least one notch formed in an upper edge thereof and a locking slot formed in the upper half of said front panel, downwardly from said upper edge;

a first substantially triangular side panel, said first side panel having a tuck tab formed thereon;

a second substantially triangular side panel;

a rear panel pivotally connected to the second side panel and capable of engagement with the tuck tab formed on the first side panel;

said rear panel being slightly shorter than said front panel but no more than half and having an integral brace section at the upper end thereof, said brace section having a locking tab formed thereon, said brace section capable of folding intermediate and extending between the first and second side panels, and being sized such that said brace section engages said locking slot in said front panel when said display assembly is erected; said integral brace section of the rear panel folded angularly downwardly and inwardly from a top of said rear panel, said brace section being generally incontiguous with said front panel with only its locking tab extending through the locking slot of said first panel; and a hanging tray including at least one attachment element which engages said at least one front panel notch to support said hanging tray on said display assembly front panel.

7. The display assembly of claim 6 comprised of corrugated paper board.

* * * * *